United States Patent [19]

Loebach

[11] 4,381,106

[45] Apr. 26, 1983

[54] COLLECT CYLINDER FOR A ROTARY FOLDER

[75] Inventor: Michael H. Loebach, Red Lion, Pa.

[73] Assignee: Motter Printing Press Co., York, Pa.

[21] Appl. No.: 271,407

[22] Filed: Jun. 8, 1981

[51] Int. Cl.[3] ..... B42C 1/04

[52] U.S. Cl. ..... 270/47; 270/60

[58] Field of Search ..... 270/60, 6, 7, 13, 14, 270/19, 47–50

[56] References Cited

U.S. PATENT DOCUMENTS

| | | | |
|---|---|---|---|
| 2,797,084 | 6/1957 | Hilgoe . | |
| 3,865,361 | 2/1975 | Neal . | |
| 3,921,968 | 11/1975 | Thomas | 270/60 |
| 4,094,499 | 6/1978 | Thomas | 270/60 |

*Primary Examiner*—A. J. Heinz

*Attorney, Agent, or Firm*—Brumbaugh, Graves, Donohue & Raymond

[57] ABSTRACT

A folder collect cylinder comprises at least five gripper mechanisms and an equal number of tucking mechanisms controlled by non-rotating cams that are selectively masked by masking cams that rotate about an axis coincident with the cylinder axis. The masking cams are driven from the main collect cylinder drive through a transmission that can be adjusted to change the speed ratio of the masking cams to the collect cylinder and the phase of the masking cams to the gripper mechanisms to provide non-collect, two-collect, three-collect and partial-collect without ever masking the taking surface of the non-rotating gripper cam during a taking phase of any gripper mechanism.

6 Claims, 7 Drawing Figures

COLLECT CYLINDER FOR A ROTARY FOLDER

The present invention relates to printing press folders and, in particular, to a collect cylinder for a variable rotary folder that can be easily and quickly adjusted to handle products of various sizes and to provide straight delivery, two collect delivery, three collect delivery or partial collect delivery.

BACKGROUND OF THE INVENTION

For efficient utilization of the very high capital investment involved in large, modern-high speed printing presses, it is virtually essential that the press delivery system, i.e., the folder, be capable of handling products of various sizes, both as to sheet size and the number of sheets that make up the end product. One aspect of the assembly of the final product from the printed web involves the ability of the folder to deliver successive intermediate products to the jaw cylinder directly, which is referred to as "straight delivery", or to collect two or even three intermediate products and deliver the collected products to the jaw cylinder, which is usually referred to as "two collect" or "three collect". Occasionally, it may be desirable for the folder to straight deliver one intermediate product and collect two other intermediate products, an operation usually termed partial collect.

Folder collect cylinders that are designed to provide either straight or collect delivery have been proposed before. For example, the folders of U.S. Pat. No. 2,797,084 issued June 25, 1957 and U.S. Pat. No. 3,865,361 issued Feb. 11, 1975, include collect cylinders having two running cam surfaces, each of which has a different profile. The follower for each pin mechanism can be adjusted to follow one or the other of the two cam surfaces, one of which provides straight delivery and the other of which provides collect delivery. Although the systems described in those patents are workable and not unduly difficult to produce and operate, they are inherently limited to either straight operation or two collect operation. Neither system provides three collect or partial collect.

U.S. Pat. No. 4,094,499 issued June 13, 1978, describes and illustrates a collect cylinder that can be adjusted for straight operation or collect operation. The gripper mechanism is controlled by a stationary cam that is profiled to open the gripper and accept a product at a taking station and to open and release the product at a delivery station but otherwise maintains the gripper closed. A rotatable running cam is mounted eccentrically, relative to the axis of the cylinder and to the axis of the stationary cam, and has camming surfaces that selectively mask the release profile of the stationary cam, thereby preventing the gripper from opening and releasing the sheet or sheets constituting the intermediate product. Because of the eccentricity of the running cam, it is said that the opening and closing of the gripper at the taking station may occur over a comparatively long time, inasmuch as the masking cam cannot in any event mask the taking profile of the stationary cam. The collect cylinder described in U.S. Pat. No. 4,094,499 appears to be capable of being designed to afford considerable versitility as to the number of intermediate products collected. On the other hand, manufacturing difficulties are inherent in making the eccentric mounting for the rotary cam and in the special machining of the masking surfaces of the rotary cam. Because the center of rotation of the rotary cam is eccentric, with respect to axis of the stationary cam, the masking surfaces of the rotary cam should not be arcuate with respect to the center of rotation but instead should be specially profiled to insure against movement of the grippers when they are silenced.

SUMMARY OF THE INVENTION

There is provided, in accordance with present invention, an improved variable collect cylinder that can be quickly and easily adjusted to handle intermediate products of various sizes and to deliver those products by straight delivery or two collect, and, if desired, three collect or partial collect. Like conventional folder collect cylinders that are in widespread use a collect cylinder embodying the present invention has a multiplicity of gripper mechanisms located equidistant for each other circumferentially. Each mechanism includes a multiplicity of gripper fingers that are adapted selectively to grip intermediate products delivered to the cylinder. The gripper mechanisms are controlled, in part, by a non-rotating gripper cam having arcuate holding surfaces of a selected radius "R" that maintain the gripper mechanisms in product-holding positions except at a product-taking zone and a product-releasing zone. The non-rotating gripper cam further includes a taking surface that controls the movement of the gripper mechanisms to open positions to take intermediate products at the taking zone and a releasing surface that controls the movements of the gripper mechanisms to open positions to release the products at the releasing zone. The cylinder also has a number of tucking blade mechanisms (equal to the number of gripper mechanisms) located equidistant from each other circumferentially. The tucking mechanisms are controlled by a non-rotating cam having a retracting surface of a radius "X" that maintains the tucking mechanisms in a retracting mode except at a tucking location where a tucking cam surface activates the tucker mechanisms, which tuck the products into the jaws of the jaw cylinder. A series of transversely spaced-apart tapes wrap a zone of the path traversed by the surface of the cylinder between the location where the products first meet the cylinder and a location near the tucking position and hold the products on the collect cylinder between the acceptance and delivery points.

In accordance with the present invention, the gripper mechanisms are selectively silenced at the releasing zone of the collect cylinder by a rotating gripper masking cam that is mounted for rotation about an axis coincident with the axis of rotation of the collect cylinder and has a multiplicity of circumferentially spaced-apart arcuate masking surfaces of the same radius "R" as the holding surfaces of the non-rotating gripper cam. The rotating gripper masking cam rotates at a speed that is different from, but is a function of, the speed of rotation of the collect cylinder such that selected gripper mechanisms traverse one of the masking surfaces and remain radially stationary throughout the releasing zone and thereby carry products past the tucking location.

For folders that are built for both two collect and three collect, the drive for the rotary masking cam is constructed so that the ratio of the speed of rotation of the masking cam to the speed of rotation of the collect cylinder can also be changed. In all folders embodying the invention, the circumferential position of the masking cam at any predetermined reference location, relative to the circumferential position of the gripper mechanism at that location, can be changed, thereby to alter the phase relationship between the masking cam and the releasing cam. The changes in speed ratio and phase enable operation in non-collect, two-collect, three-collect or partial collect modes without ever masking the taking surface of the non-rotating gripper cam during a taking phase of any gripper mechanism.

To provide the capability of three collect, there must be at least five gripper mechanisms and, of course, a corresponding number of tucking mechanisms.

A collect cylinder embodying the present invention can be operated in the various modes without silencing the tucking blade, although the jaws of the jaw cylinder must, of course, be silenced to prevent them from taking products when they should not be doing so. Preferably, however, the collect cylinder includes a tucker masking cam that is mounted for rotation about an axis coincident with the axis of rotation of the collect cylinder and has a multiplicity of tucker masking surfaces of the same radius "X" as the retracting surface of the stationary tucker cam. The tucker masking cam is, preferably driven by the same drive as the gripping masking cam.

For better understanding of the present invention, reference may be made to the following description of an exemplary embodiment, taken in conjunction with the figures of the accompanying drawings.

DESCRIPTION OF THE EXEMPLARY EMBODIMENT

Figure 1:
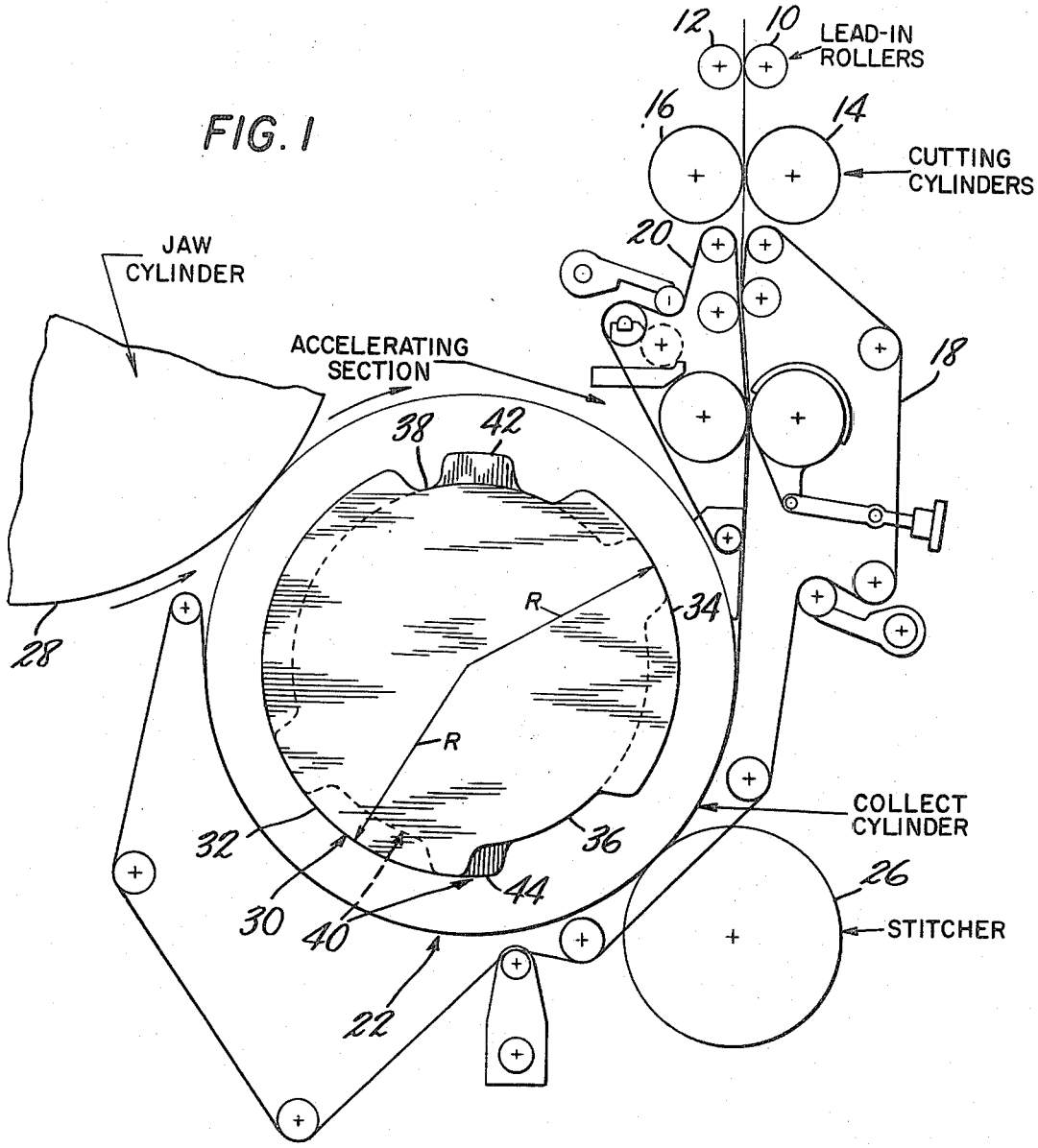
FIG. 1 is a schematic side elevational view of the accelerating section, the collect cylinder and part of the jaw cylinder of a press delivery system in which the collect cylinder embodies the present invention.

After the printed web leaves the printing press, it is slit into "ribbons", which are laid over one another and passed between a pair of lead-in rolls 10 and 12 and then between cutting cylinders 14 and 16 that cut them into an "intermediate product", a stack of sheets cut from the ribbons. Each intermediate product is picked up by an accelerating section composed of a series of tapes 18 and 20 on either side of the intermediate products and is delivered at a slightly increased speed (in order to separate successive intermediate products in the machine direction) to the collect cylinder 22. Initially, the intermediate products brought into contact with the collect cylinder 22 are held against the cylinder and maintained in the proper position for subsequent gripping and tucking by the tapes 18, which wrap around the collect cylinder from the acceptance point to close to the tucking point. Shortly after the intermediate products contact and run with the collect cylinder, a gripper mechanism that is then in position under the leading edge of the intermediate product opens and then recloses to grip the leading edge of the product. With suitably fitted-out equipment, the product may be stitched while it is on the collect cylinder by a stitcher 26.

After the product is "taken" by the gripper assembly, it is carried around on the collect cylinder to a jaw cylinder 28 to which it may be transferred by a tucker mechanism. The transfer takes place in the case of straight delivery with each product delivered to the collect cylinder after partial rotation from delivery to the collect cylinder to the taking position at the jaw cylinder. However, in the case of two collect or three collect, two or three individual products coming from the accelerating section are picked up on each gripper and are transferred to the jaw cylinder only after the desired two or three products are collected. This means that each gripper mechanism must pass the jaw cylinder once or twice without releasing the product or products to the jaw cylinder. When individual products or collections of products are to be transferred to the jaw cylinder, the gripper that is holding each such individual product or collection of products is opened in timed relation with the operation of the applicable tucker mechanism, i.e., at a position in the rotation of the cylinder when the tucker mechanism transfers the product or products to the jaw cylinder and, therefore, at a position of the particular gripper mechanism that is past the tucking location by a distance approximately equal to the page width.

The operation of the gripper mechanisms is controlled by a stationary gripper cam 30 having arcuate holding surfaces 32 and 34 over most of its circumference that are of a selected radius "R" and maintain the gripper mechanisms in product-holding positions with the gripping fingers in engagement with the product or products except at a taking zone 36 and a releasing zone 38 generally in the form of notches in the cam that control the movement of each gripper mechanism to an open position for taking and releasing the product or products. Each gripper mechanism of the collect cylinder is, however, also controlled, as described in greater detail below, by a rotating masking cam 40 that has at least two masking surfaces 42 and 44 located diametrically opposite each other and of radiuses equal to the radius "R" of the fixed gripper cam 30. The masking cam is mounted for rotation on an axis coincident with the axis of the collect cylinder 22 and is driven at a selected speed that is unequal to, but is a function of, the speed of rotation of the collect cylinder. The rotational position of the masking cam 40, relative to the fixed cam 30, at any selected reference location, with respect to the position of the gripper mechanisms, can be adjusted to mask the releasing surface 38 of the fixed cam 30 to provide straight delivery, two collect delivery, three collect delivery and partial collect delivery of products from the collect cylinder to the jaw cylinder. Such adjustments are made in conjunction with varying the ratio of the speed of rotation of the masking cam to the speed of rotation of the collect cylinder.

Figure 3:
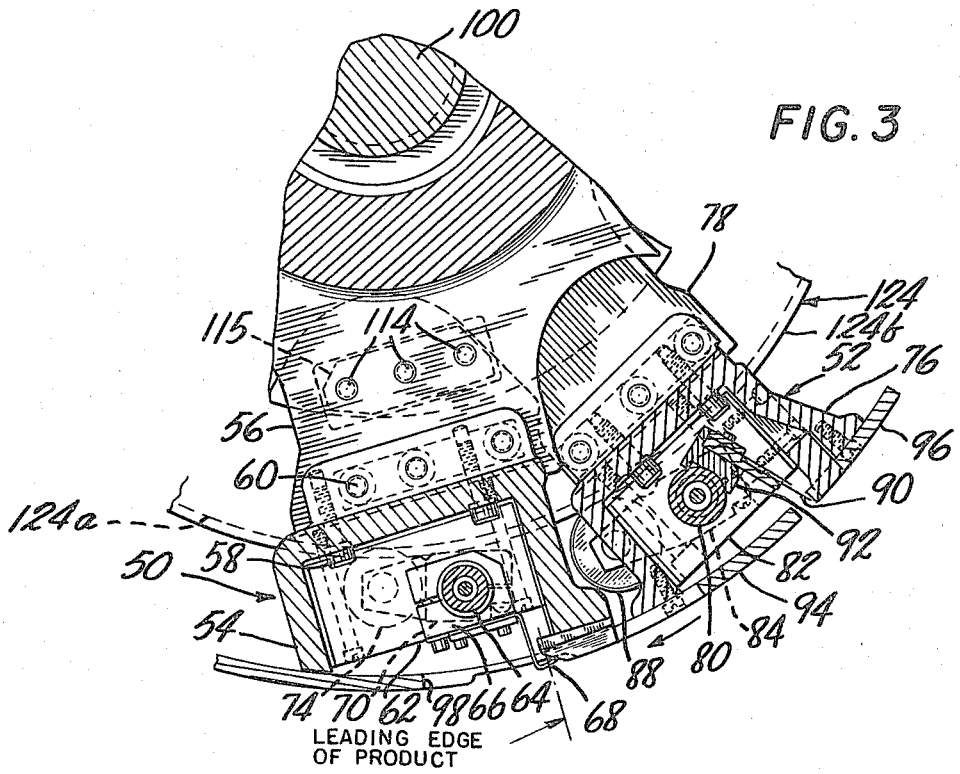
FIG. 3 is a partial cross-sectional view of the collect cylinder taken along a plane perpendicular to the axis of the collect cylinder.
Figure 4:
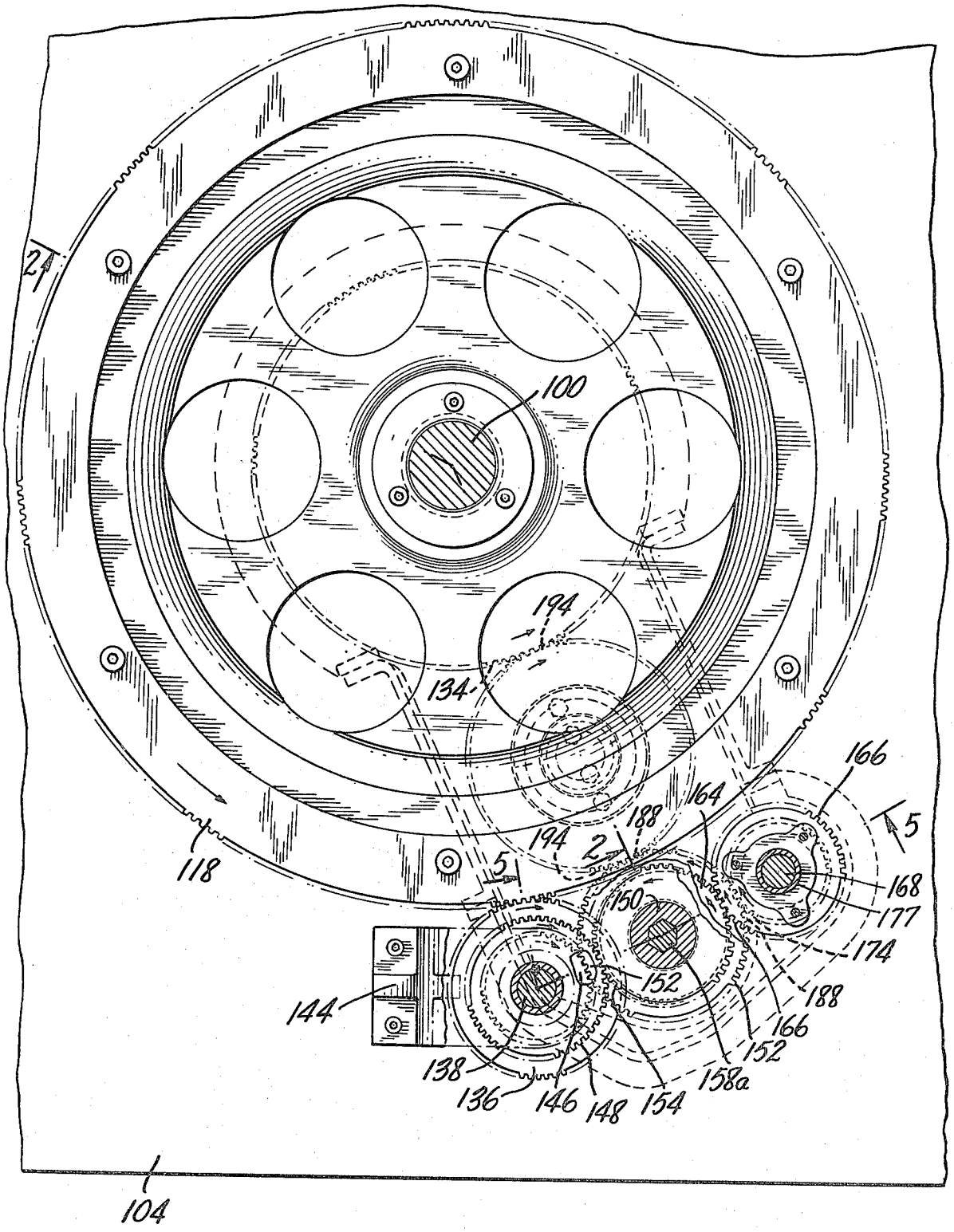
FIG. 4 is an end cross-sectional view of the drive for the masking cams of the collect cylinder.

The embodiment of the invention shown in the drawings is a variable folder capable of handling two streams of products, one on either side of a vertical center plane. Each section of the folder has five gripper mechanisms 50 spaced equidistant around the circumference of the cylinder and a corresponding set of five equally spaced tucker mechanisms 52. As shown in FIG. 3, each gripper mechanism 50 includes a holder 54 that is fastened near each end to a spider 56 by bolts 58 and 60. End plates 62 carry a transverse gripper shaft 64 that, in turn, carries a series of spaced-apart gripper brackets 66. Each such bracket near the center carries a gripper finger 68, which may be of any suitable design but is preferably of the type described and shown in U.S. patent application Ser. No. 299,650, filed Sept. 14, 1981, and entitled Gripper for Sheet Handling Equipment and owned by the assignee of the present invention. In order to accommodate products of various page heights, a group of comparatively closely spaced gripper brackets 66 are installed at the outboard end of the mechanism, and fingers 68 can be placed in selected positions while other selected gripping fingers are removed. The tapes 18 are trained over the collect cylinder in between the grippers, and the tapes near the end of the cylinder can be moved to accommodate the selected positions of the gripper fingers used for a particular job. The shaft 64 of the gripper mechanism extends out through the bearing in the outboard end plate and receives a lever 70 carrying a pair of cam followers 72 and 74.

Figure 2:
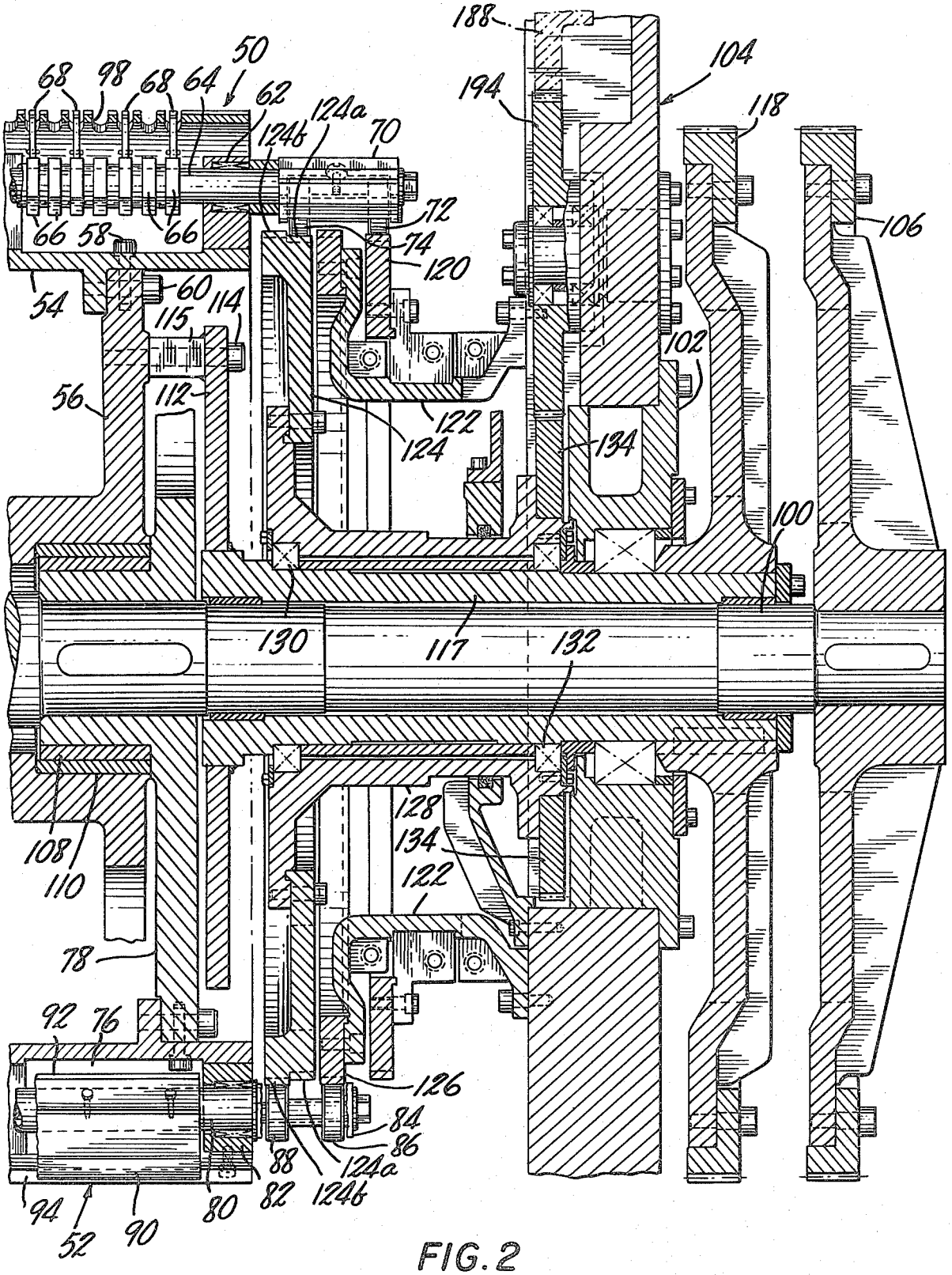
FIG. 2 is a cross-sectional view of the collect cylinder taken generally along the axial-radial planes represented by the lines 2—2 in FIG. 4.

Each of the five tucker mechanisms 52 of the collect cylinder comprises a holder 76 that is affixed to a spider near each of the section, e.g. the spider 78 shown in FIG. 2, and a tucker bar shaft 80 supported for rotation by bearings in end plates, e.g. 82. The outboard end of the tucker shaft 80 extends out through the end plate 82 and receives a lever arm 84 that is fitted with a pair of follower rollers 86 and 88. A tucker blade 90 is suitably attached to the shaft 80 by brackets 92. The surface of the collect cylinder is composed of curved plates, for example, the plates 94 and 96 shown in FIG. 3, that are fastened to the frames 52 of the tucker mechanisms and have slots 98 through which the tips of the gripper fingers 68 extend.

The spiders, e.g. 78, that carry the tucker mechanisms 52 are attached to the main shaft 100 of the collect cylinder. The shaft 100 is journalled in a bearing 102 mounted in the side frame 104 on the drive side of the machine, and a similar bearing (not shown) on the operating side of the machine (not shown). The drive end of the shaft 100 carries a main collect cylinder drive gear 106.

The spiders, e.g. 56, that carry the gripper mechanisms 50 rotate with the collect cylinder but are carried on the hubs of the tucker mechanism spiders by bushings 108 and 110 in order that the positions of the gripper mechanism can be adjusted circumferentially to accommodate products of various around-the-cylinder sizes. The drive side spider 56 is connected to a drive ring 112 by bolts 114 and spacer rings 115 that pass through the spaces between the legs of the spider 78, and the ring 112, in turn, is connected to a gripper drive sleeve 117 to which a gripper drive gear 118 is affixed. The input gearing (not shown) to the gripper drive gear 118 is constructed to allow the positions of the gripper mechanisms to be adjusted circumferentially for the aforementioned product-size adjustment.

The gripper mechanisms 50 are controlled by (1) a stationary gripper cam 120 (corresponding to the fixed gripper cam 30 shown in FIG. 1) that is mounted on brackets 122 and (2) a rotating masking cam 124 (see also 40, FIG. 1) and, in particular, a cam surface 124*a* that controls the follower roller 74. The tucker mechanisms 52 are controlled by a fixed cam 126 and a masking cam surface 124*b* on the rotatable masking cam 124. The grippers and tuckers are spring-biased against the cams in a known manner. The masking cam 124 is carried by a masking cam holder 128 that rotates on bearings 130 and 132 about an axis coincident with the axis of the collect cylinder shaft 100. The outboard end of the masking cam holder 128 carries a gear 134.

Figure 5:
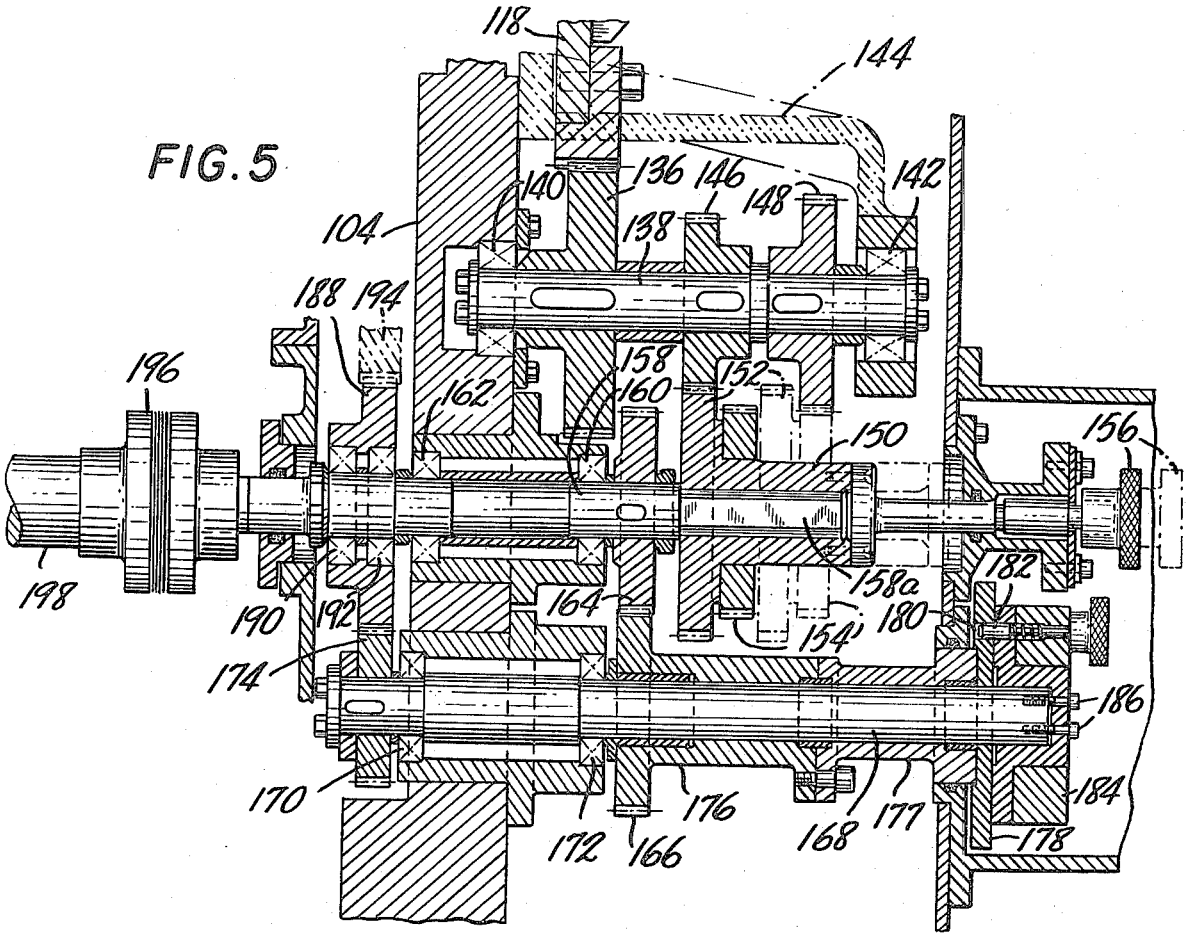
FIG. 5 is a bottom cross-sectional view of the drive taken generally along a broken plane indicated generally by the lines designated 5—5 in FIG. 4.

Referring to FIG. 5, the gripper drive gear 118 drives a gear 136 that is keyed on a shaft 138. The shaft 138 rotates in bearings 140 and 142 in the side frame 104 and in a bracket 144 affixed to the frame and has fixed gears 146 and 148 with different numbers of teeth. Depending on the position of an axially shiftable double gear 150, the gear 146 drives a gear 152 or the gear 148 drives a gear 154. A control knob 156 operated from the drive side of the machine shifts the double gear along a polygonal segment 158*a* of a shaft 158 that rotates in bearings 160 and 162 in the side frame 104. A gear 164 keyed to the shaft 158 rotates at different speeds, depending upon which of the gears 152 and 154 is engaged by the selection afforded by the control knob 156. The gear 164 drives a gear 166 that is mounted by bushings on a shaft 168. The shaft 168 rotates on bearings 170 and 172 and carries a fixed gear 174. The hub 176 of the gear 166 is coupled to a hub extension 177 that is, in turn, connected to an adjustment plate 178 having a series of holes 180, any of which can receive a spring-loaded locking pin 182 on a head 184 that is affixed by screws 186 to the outboard end of the shaft 168. Accordingly, the drive from the gear 164 to the gear 166 is transmitted through the hub 176, the hub extension 177, the adjusting plate 178 and the head 184 into the shaft 168. A gear 174 on the inboard end of the shaft meshes with an idler gear 188 carried by bearings 190 and 192 on the shaft 158. The gear 188 meshes with another idler gear 194 that, in turn, meshes with and drives the masking cam drive gear 134.

The two adjustments required to set up the collect cylinder for straight delivery, two collect, three collect or partial collect are (1) a change in gear ratio accomplished by shifting the double gear 150 by means of the control knob 156, thereby to change the speed of the masking cams 124*a* and 124*b*, and (2) rotation of the head 184 relative to the adjustment disc 178, thereby to change the phase relationship between the masking cams and the fixed cams with reference to the grippers. When the shaft 168 is uncoupled from the rest of the transmission by pulling out the locking pin 182, rotation of the head 184 rotates the shaft 168, and that rotation is transmitted through the gears 174, 188 and 194 to the masking cam holder 128 through the masking cam drive gear 134.

As mentioned at the beginning of this detailed description, the exemplary embodiment shown in the drawings contains two virtually identical collection sections so that two streams of intermediate products can be handled side-by-side on the collect cylinder. Accordingly, the shaft 158 of the transmission that drives the drive side section of the collect cylinder is connected by a coupling 196 to a cross-shaft 198 that carries the masking cam drive across the machine to the operating side section. It will be understood by those skilled in the art that the operating side section of the collect cylinder may include a transmission for adjusting the phase relationships between the masking cam and the grippers and tuckers on the operating side section so that the mode of operation of the operating side section can be different from the mode of operation of the drive side section. With a different transverse drive take off, the operating side section can also be built for speed ratio adjustment.

EXAMPLE OF A SPECIFIC CAM DESIGN

Figure 6:
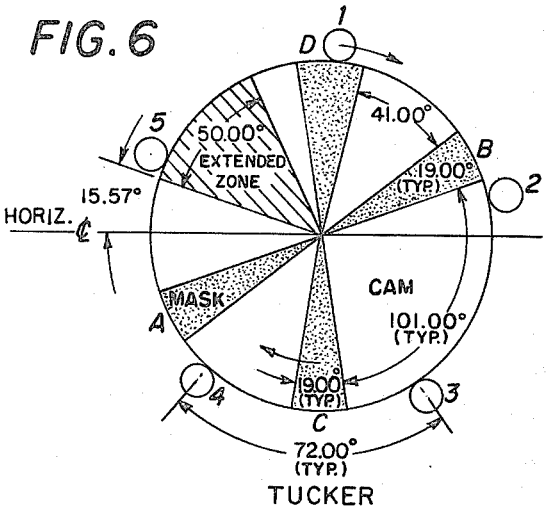
FIG. 6 is a diagram of the stationary and rotary tucker cams of the embodiment.
Figure 7:
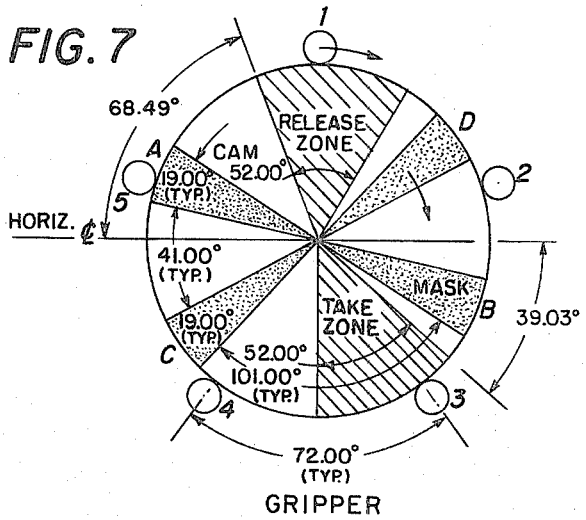
FIG. 7 is a diagram of the stationary and rotary gripper cams of the embodiment.

FIGS. 6 and 7 are diagrams of specific designs for the stationary cams and masking cams for the tucker mechanisms and gripper mechanisms, respectively. The small circles numbered 1 through 5 around the large circles represent the five tucker followers (FIG. 6) and the five gripper followers (FIG. 7). The notched portion of the stationary tucker cam that controls the extensions of the tucker mechanisms is represented by the cross-hatched, pie-shaped segment in FIG. 6. The lobes of the rotating tucker masking cam are represented by the shaded areas. In essence, the rotating masking cam has six lobes of 19° each located equal distances apart. However, only two lobes or four lobes are actually used in any mode of operation. In practice, only the two pairs shown are formed on the cam, and one pair is constructed to be removable.

In a manner similar to FIG. 6, the diagram in FIG. 7 illustrates the take zone and release zone of the stationary gripper cam by the cross-hatched areas and depicts the lobes of the rotating gripper masking cam by the shaded pie-shaped areas. As with the tucker masking cam, the gripper masking cam is a six-lobed cam having identical lobes spaced equal distances from each other, but two lobes are omitted altogether and two other lobes are removable from the cam for one mode of operation.

With the cam designs shown in FIG. 6, the collect cylinder is set up for non-collect (i.e., no masking) by adjusting the mask phase by means of the adjusting plate 178 (FIG. 5) so that masking lobe A is separated by 2.00° from the ingoing side of the extended zone of the fixed tucker cam when the follower 1 is exactly at the ingoing end of the extended zone and by adjusting the shiftable double gear 150 so that the mask rotates at 5/6ths the speed of the collect cylinder. In practice, the required mask phase adjustment is built into the transmission in the form of a specific hole in the adjusting plate 178 for reception of the lock pin 182, and the speed ratio adjustment is built into the shiftable gearing. Because the rotation of the masking cam lags the rotation of the cylinder, follower 1 will run ahead of lobe A entirely through the extended zone. After 72° of rotation, follower 2 reaches the ingoing end of the extended zone 2° ahead of lobe C, so follower 2 runs unmasked through the extended zone. Follower 3 runs through the extended zone at a substantial distance from either lobes C or B. Follower 4 reaches the extended zone 2° ahead of lobe B. And so forth.

In the initial set up of the gripper stationary and masking cams for non-collect, lobe A is separated by 3.88° from the ingoing end of the release zone when follower 1 is exactly at the ingoing end of the release zone. It can be shown graphically or using models or computer simulation that each gripper follower runs through the release zone clear of any of the masking lobes, and, similarly, runs clear through the take zone. The aforementioned setting for non-collect is applicable to the maximum size product in the particular design, and the exact setting varies slightly in accordance with the repositioning of grippers and the the release zone and take zone when the fixed gripper cam is adjusted for a particular product size.

For three-collect operation the mask ratio (speed ratio) remains the same (5/6ths) but the mask phase is set 15° forward, relative to the non-collect mode. Therefore, when tucker follower 1 is at the ingoing end of the release zone, lobe A is 13° into the take zone. When gripper follower 1 is at the ingoing end of the release zone, gripper mask lobe A is 11.12° into the take zone. Masking occurs in the following sequence: 1, 2, 4, 5, 2, 3, 5, 1, 3, 4, etc., and the cylinder collects three incoming products received A, B, C, and releases them as A/B/C products in the sequence 3, 1, 4, 2, 5.

For partial collect, i.e., reception of series of three products A, B, and C and delivery in the sequence A, B/C, A, B/C, etc., the mask phase and mask ratio are the same as in three-collect, but mask lobes C, and D of both the gripper and tucker masking cams are removed. Accordingly, masking occurs for both the tucker and gripper in the sequence 1, 4, 2, 5, 3, etc., and release occurs in the sequence 2, 3, 5, 1, 3, 4, 1, 2, 4, 5.

For two-collect operation, masking lobe A of the tucker mask cam is adjusted to overlap the extended zone by 1.50° the ingoing end of the extended zone when tucker follower 1 is at the ingoing end of the extended zone. This setting automatically positions gripper mask lobe A with a 4.32° overlap of the ingoing end of the release zone when gripper cam 1 is exactly at the ingoing end of the release zone. The gear ratio of the transmission for the rotating cams is reset to drive the masking cams at a speed 5/4ths of the speed of the collect cylinder. In two-collect, the masking sequence is 1, 2, 5, 2, 4 and a sequence of incoming products A, B, A, B, etc. is collected on the collect cylinder and is delivered to the jaw cylinder as two-collect products A/B in the sequence 2, 4, 1, 3, 5.

I claim:

1. In a folder collect cylinder having a multiplicity of gripper mechanisms spaced equidistant apart circumferentially and each having a multiplicity of gripper fingers actuated by a gripper cam follower to open and close selectively to grip products delivered to the cylinder, a non-rotating gripper cam having arcuate holding surfaces of a radius "R" adapted to engage the gripper cam followers and maintain the gripper mechanisms in product-holding positions except at a taking zone and a releasing zone and having a taking surface adapted to control through the gripper cam followers the movements of the gripper mechanisms to open positions to take products at the taking zone and a releasing surface adapted to control through the gripper cam followers the movements of the gripper mechanisms to open positions to release gripped products at the releasing zone, a number of tucking mechanisms equal to the number of gripper mechanisms spaced equidistant apart circumferentially each having a tucker blade actuated by a tucker cam follower and adapted to tuck products selectively into jaws on a jaw cylinder at a selected tucking location, a non-rotating tucking cam having a retracting surface of a radius "X" adapted to maintan through the tucker cam followers the tucking mechanisms in a retracted mode except at the tucking location and having a tucking surface adapted to control through the tucker cam followers the extension of the tucker mechanisms to tuck products into jaws of the jaw cylinder at the tucking location, and a multiplicity of tapes wrapping a zone of the cylinder path traversed by the surface of the cylinder between the location where the products first meet the cylinder and a location proximate to the tucking position and adapted to hold the products on the collect cylinder between said locations, the improvement comprising a gripper masking cam mounted for rotation about an axis coincident with the axis of rotation of the collect cylinder and having a multiplicity of circumferentially spaced-apart arcuate masking surfaces of the same radius "R" as the holdinbg cam surfaces of the non-rotating gripper cam that are selectively engageable with a second gripper cam follower on each gripper mechanism, drive means for rotating the masking cam at a speed that is different from but is a function of the speed of rotation of the collect cylinder such that the second gripper cam followers of selected gripper mechanisms may selectively traverse one of the masking surfaces and remain radially stationary throughout the releasing zone and thereby carry products past the tucking location and means for setting the circumferential position of the masking cam at a predetermined location relative to the circumferential positions of the gripper mechanisms and thereby establish a predetermined selected relationship between the masking cam phase and the gripper cam phase with reference to the gripper mechanisms for selection of at least non-collect and multiple collect without ever masking the taking surface of the non-rotating gripper cam during a taking phase of any gripper mechanism.

2. The improvement according to claim 1 wherein the gripper masking cam has at least one pair of masking surfaces, the surfaces of each such pair being diametrically opposed and all such surfaces being identical.

3. The improvement according to claim 1 wherein the drive means includes means for changing the ratio of the speed of rotation of the masking cam to the speed of the collect cylinder.

4. The improvement according to claim 1 or claim 2 or claim 3 wherein the drive means includes a gear transmission having means for disengaging a gear, changing its position and reengaging it, thereby to change the circumferential position of the gripper masking cam.

5. The improvement according to claim 1 or claim 2 or claim 3 and further comprising a tucking masking cam mounted for rotation about an axis coincident with the axis of rotation of the collect cylinder and having a multiplicity of tucking masking surfaces of the same radius "X" as the retracting surface of the tucking cam that are selectively engageable with a second tucker cam follower on each tucker mechanism, the tucking masking cam being rotatable by the drive means.

6. The improvement according to claim 5 wherein the tucking masking cam has at least one pair of masking surfaces, the surfaces of each such pair being diametrically opposed and all such surfaces being identical.

* * * * *